US009149679B2

(12) United States Patent
Abassian

(10) Patent No.: US 9,149,679 B2
(45) Date of Patent: Oct. 6, 2015

(54) ELASTOMERIC CORD-RESISTANCE UNIT

(71) Applicant: Hovhanes Abassian, Glendale, CA (US)

(72) Inventor: Hovhanes Abassian, Glendale, CA (US)

( * ) Notice: Subject to any disclaimer, the term of this patent is extended or adjusted under 35 U.S.C. 154(b) by 0 days.

(21) Appl. No.: 14/524,805

(22) Filed: Oct. 27, 2014

(65) Prior Publication Data

US 2015/0051055 A1 Feb. 19, 2015

Related U.S. Application Data

(63) Continuation-in-part of application No. 13/587,775, filed on Aug. 16, 2012, now abandoned.

(51) Int. Cl.

| | |
|---|---|
| ***A63B 21/04*** | (2006.01) |
| ***A63B 21/055*** | (2006.01) |
| ***A63B 21/00*** | (2006.01) |
| ***A63B 22/06*** | (2006.01) |
| ***A63B 23/12*** | (2006.01) |
| *A63B 21/16* | (2006.01) |

(52) U.S. Cl.

CPC ..... *A63B 21/055* (2013.01); *A63B 21/00069* (2013.01); *A63B 21/00072* (2013.01); *A63B 21/0414* (2013.01); *A63B 21/0428* (2013.01); *A63B 21/0557* (2013.01); *A63B 21/1453* (2013.01); *A63B 21/1465* (2013.01); *A63B 21/1469* (2013.01); *A63B 21/154* (2013.01); *A63B 22/0694* (2013.01); *A63B 23/1218* (2013.01); *A63B 23/1281* (2013.01); *A63B 2021/1609* (2013.01); *A63B 2208/0204* (2013.01); *A63B 2208/0233* (2013.01); *A63B 2210/50* (2013.01); *A63B 2225/09* (2013.01); *A63B 2225/093* (2013.01)

(58) Field of Classification Search

CPC ..... A62B 23/02; A62B 23/0211; A63B 2023/006; A63B 21/04; A63B 21/0407; A63B 21/4028; A63B 22/0694; A63B 23/1281; A63B 2021/1609; A63B 2021/1465

USPC ..... 482/52, 79, 80, 91–96, 121–126, 129, 482/131, 139, 907; 601/5

See application file for complete search history.

(56) References Cited

U.S. PATENT DOCUMENTS

| | | | |
|---|---|---|---|
| 5,669,863 | A | 9/1997 | Ho |
| 5,720,701 | A | 2/1998 | Truini |
| 6,001,051 | A | 12/1999 | Chuan-Pin |
| 6,814,690 | B1 | 11/2004 | Stearns |
| 7,306,547 | B2 | 12/2007 | Stearns |
| 2006/0014614 | A1 | 1/2006 | Szabo et al. |
| 2006/0270535 | A1 | 11/2006 | Casey |
| 2010/0234192 | A1 | 9/2010 | Oller, Jr. |

*Primary Examiner* — Loan H Thanh
*Assistant Examiner* — Nyca T Nguyen
(74) *Attorney, Agent, or Firm* — James E. Brunton

(57) ABSTRACT

A non-gravity type resistance exercise apparatus that includes a base assembly, a connector strut having a first end pivotally connected to the base assembly, a second end spaced apart from the first end and an intermediate portion, a first pair of sheaves rotatably connected to the connector strut, a selector assembly connected to the connector strut, a body engaging member, a second pair of sheaves rotatably connected to the body engaging member and a resistance assembly for yieldably resisting movement of the body engaging member, the resistance assembly comprising a pair of elastomeric belts entrained about the first and second pairs of sheaves.

8 Claims, 6 Drawing Sheets

ELASTOMERIC CORD-RESISTANCE UNIT

CROSS-REFERENCE TO RELATED APPLICATIONS

This is a Continuation In Part of application U.S. Ser. No. 13/587,775 filed Aug. 16, 2012

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates generally to an exercising apparatus and more particularly to a compact, multi-purpose exercise device for accomplishing a number of progressive resistance-type exercises using a novel elastomeric cord-resistance unit which provides a variable resistance to the performance of the exercises.

2. Description of Related Art Including Information Disclosed Under 37 Cfr 1.97 and 1.98

The therapeutic value of progressive resistance exercises has long been recognized. Exercising muscles against progressively increasing resistance not only results in added strength and endurance in the muscles, but also in the improvement of neuromuscular coordination and in a more efficient functioning of the cardiovascular and respiratory systems.

In the past, various types of progressive weight training machines have been suggested. Typically, the prior art exercise apparatus uses one or more weights selected from a stack of weights to provide gravity resistance to the movement of a carriage or other body engaging means. Such apparatus is inherently very heavy and not well suited for use in certain facilities. Additionally, the prior art apparatus is typically quite bulky and difficult to use in confined areas having limited ceiling heights. Further, the weight and bulk of the prior art devices makes their storage and transport quite difficult.

The apparatus of the present invention overcomes many of the drawbacks of the prior art exercise devices by providing an apparatus that is compact, lightweight, and readily usable in confined areas. The apparatus includes a non-gravity selectorized resistance module that is made up of a plurality of elastomeric cords which offer variable resistance to the trainee.

BRIEF SUMMARY OF THE INVENTION

By way of brief summary, one form of the exercise apparatus of the present invention for use by a trainee in the performance of exercises comprises a base assembly, a connector strut having a first end pivotally connected to the base assembly, a second end spaced apart from the first end and an intermediate portion, a first pair of sheaves rotatably connected to the connector strut proximate the first end thereof, a selector assembly connected to the connector strut for movement between first and second positions, a body engaging member having a first end, a second end and an intermediate portion, the second end of the connector strut being pivotally connected to the intermediate portion of the body engaging member, the body engaging member being movable between a first position and a second position, a second pair of sheaves rotatably connected to the body engaging member proximate the first end thereof and a resistance assembly for yieldably resisting movement of the body engaging member from the first to the second position, the resistance assembly comprising a pair of elastomeric belts entrained about the first and second pairs of sheaves, the elastomeric belts having a first end connected to the selector assembly and a second end connected to the body engaging member.

With the forgoing in mind, it is an object of the present invention to provide an improved, non-gravity type resistance exercise apparatus which is small, lightweight, and easy to use. More particularly, it is an object of the invention to provide an exercising device that includes a plurality of elastomeric cords which can be quickly and easily selectively coupled with the body engaging member to provide precise resistance to the performance of several different kinds of exercises.

Another object of the invention is to provide an apparatus of the aforementioned character which includes a mechanism for selectively interconnecting the body engaging member with the selected resistance imparting cords of the apparatus. The elastomeric cords can be selected so that a wide range of effective resistance can readily be achieved.

Another object of the invention is to provide an apparatus of the character described that includes novel connector elements that permit the apparatus to be connected to the seat of a chair so that exercises can be performed with the trainee sitting in the chair.

Still another object of the invention is to provide a compact, lightweight exercise apparatus that is both safe and reliable, while at the same time providing a full range of movement when performing exercises.

Another object of the invention is to provide a device as described in the preceding paragraphs that embodies a minimum number of component parts and one which is easily operable with a minimum of instruction.

DETAILED DESCRIPTION OF THE INVENTION

Figure 1:
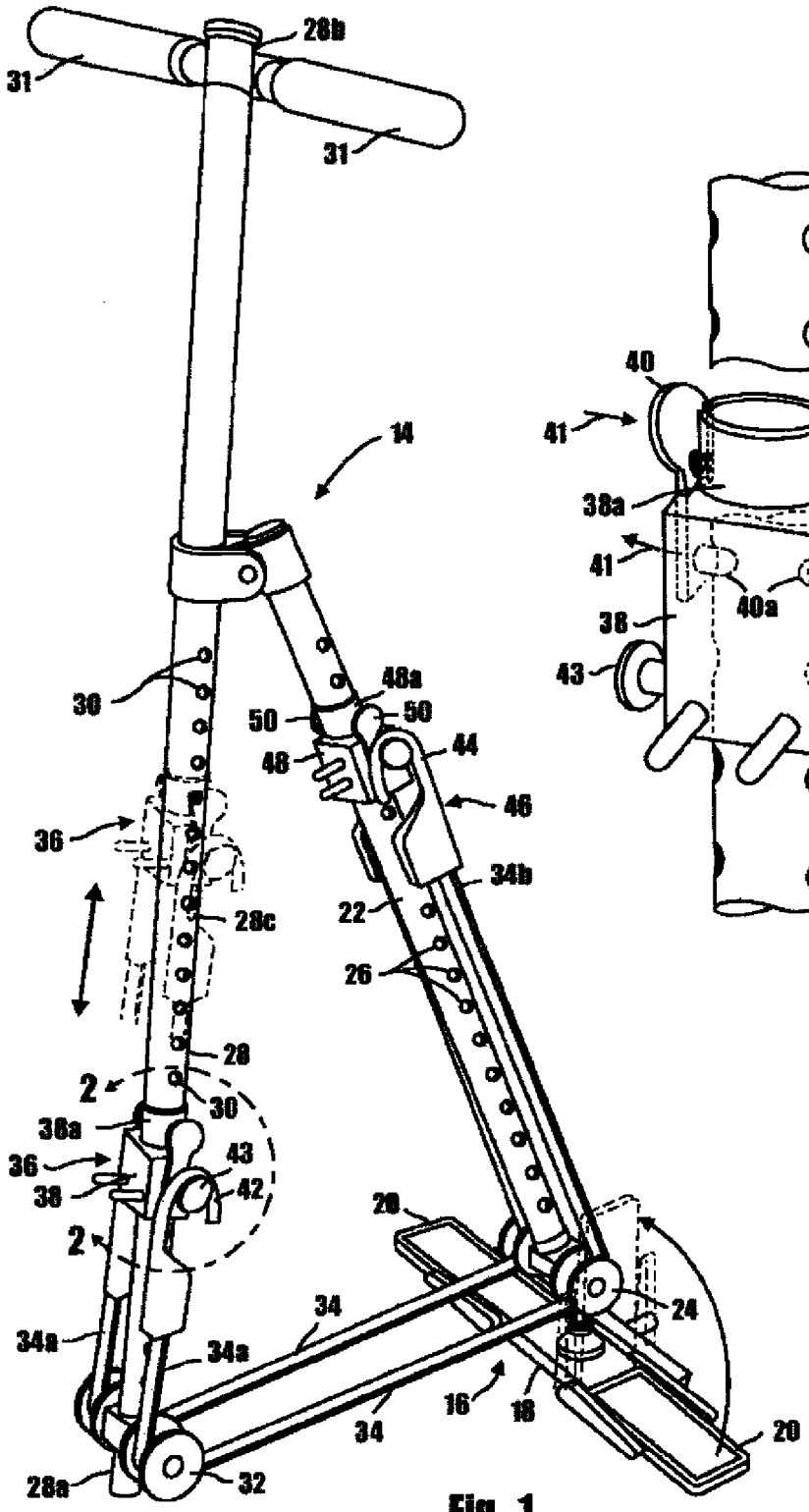
FIG. 1 is a generally perspective view, illustrating one form of the exercise apparatus of the invention.

Referring to the drawings and particularly to FIG. 1, one form of the exercise apparatus of the invention is there shown and generally designated by the numeral 14. Apparatus 14 here comprises a base assembly 16 that includes a central portion 18 and a pair of spaced apart foot engaging members 20 that are pivotally connected to the central portion for movement between the normal extended position and the stowed position shown by the dotted lines in FIG. 1. Also pivotally connected to central portion 18 of the base assembly is an elongate strut 22. Strut 22 has a first end 22*a* that is pivotally connected to the central portion of the base assembly (see FIG. 4), an intermediate portion 22*b* and a second end 22*c* that is spaced apart from first end 22*a*. Connected to connector strut 22 proximate first end 22*a* is a hub-like first guide member 24. For a reason presently to be described, the intermediate portion of the strut 22 is provided with a plurality of spaced apart apertures 26.

Figures 3, 3A:
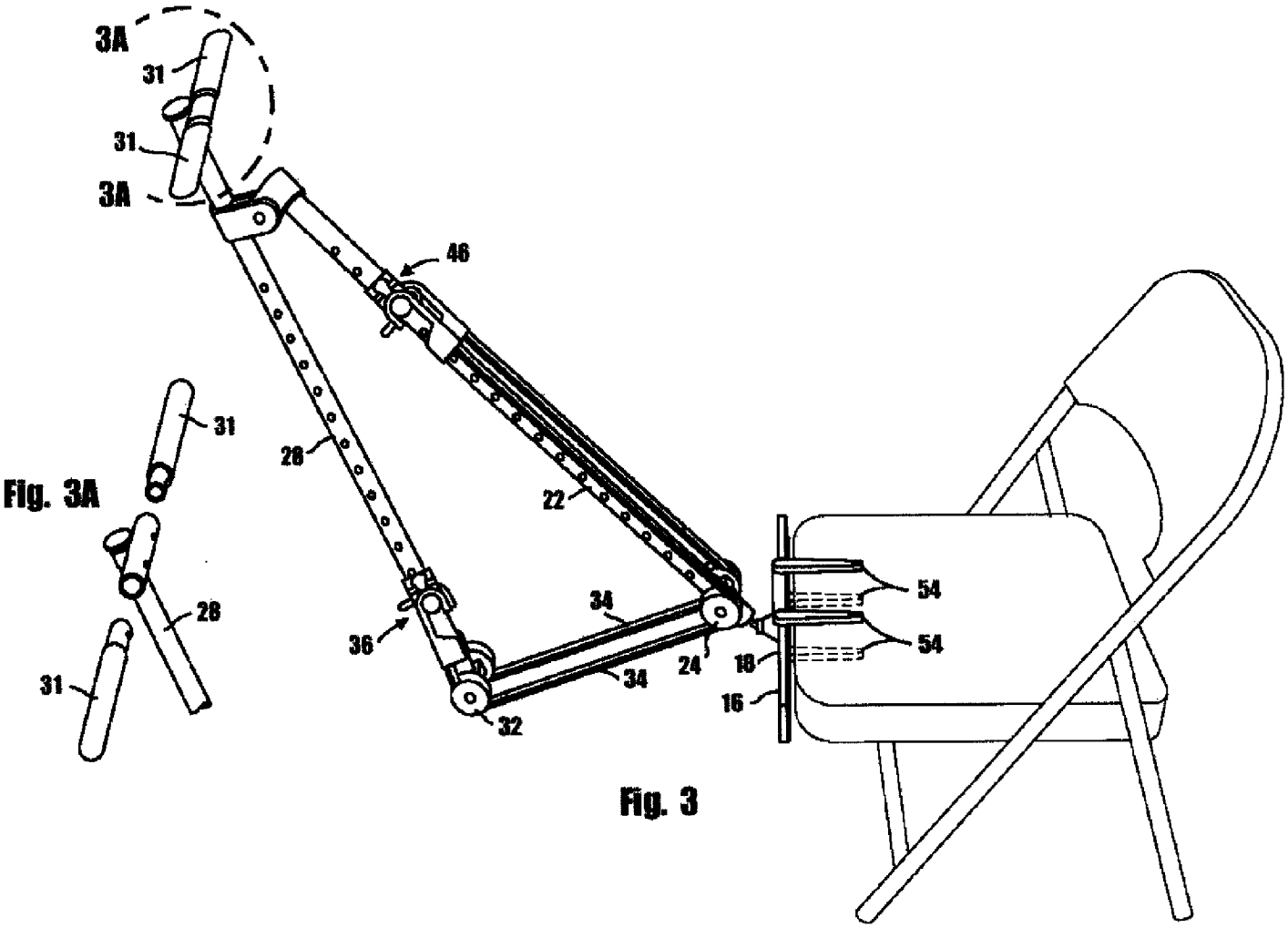
FIG. 3 is a generally perspective view illustrating the use of the exercise apparatus of the invention with a chair.
FIG. 3A is a greatly enlarged, fragmentary view of the area designated as 3A-3A in FIG. 3.
Figure 4:
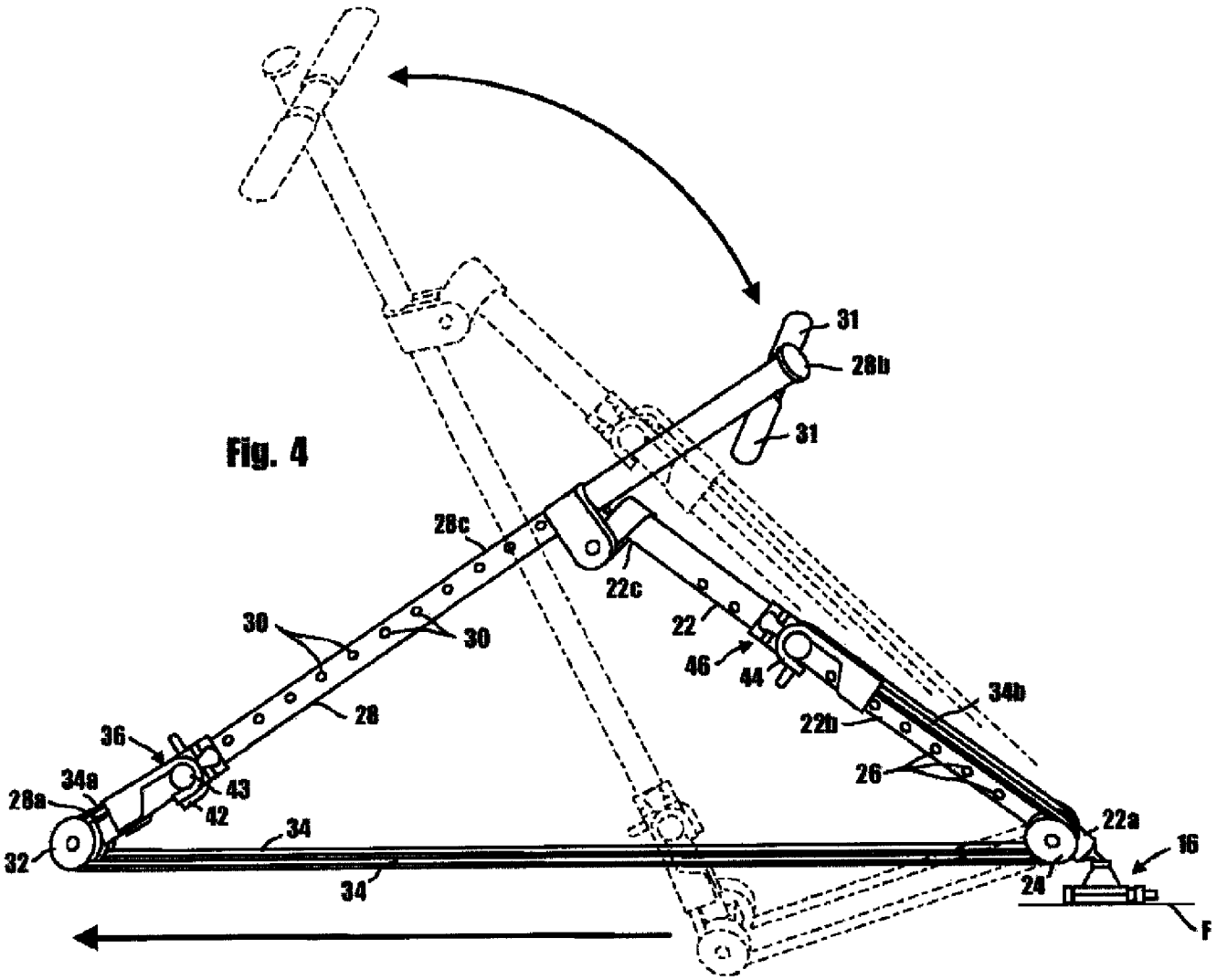
FIG. 4 is a generally diagrammatic view similar to FIG. 1 showing the use of the apparatus to perform an exercise.

Also forming a part of the exercise apparatus of the invention is an elongate body engaging member 28 that is movable by the trainee between a first position shown in FIG. 1 and a second position shown in FIG. 4. Body engaging member 28 has a first end 28*a*, a second end 28*b* and an intermediate portion 28*c*. As shown in FIG. 1, the second end 22*c* of the connector strut 22 is pivotally connected to the intermediate portion 28*c* of the body engaging member. For a reason presently to be described, the intermediate portion of the body engaging member is also provided with a plurality of spaced apart apertures 30. Connected to body engaging member 28 proximate its first end 28*a* is a second hub-like guide member 32 and removably connected to body engaging member 28 proximate its second end 28*b* is a pair of spaced apart handgrips 31 (see also FIG. 3A).

Forming an important part of the exercise apparatus of the invention is a resistance means that functions to yieldably resist movement of the body engaging member from the first position to the second position. This important resistance means here comprises a pair of stretchable members 34 that interconnect the body engaging member 28 with the connector strut 22. Stretchable members 34, which here comprise elongated elastomeric cords, are entrained about the first and second guide members 24 and 32 in the manner illustrated in FIG. 1 of the drawings. As best seen in FIG. 1, each of the stretchable members 34 has a first end 34*a* that is provided with a hook-like member 42 and a second end 34*b* that is provided with a hook-like member 44.

Connected to elongate body engaging member 28 for slidable movement between the first and second positions is a first selector assembly 36. Selector assembly 36 here includes a box-like body 38 that includes a sleeve portion 38*a* that circumscribes the body engaging member and a pair of connector toggles 40 that are operable by the trainee to permit the pin portions 40*a* of the toggles to be removed from a selected one of the apertures 30 provided in the body engaging member (see arrows 41) so as to permit the selector assembly to be moved along the body engaging member from a first position shown by the solid lines in FIG. 1 to a second position shown by the phantom lines in FIG. 1. Selector assembly 36 also includes a pair of outwardly extending connector elements 43 to which end 42 of each of the stretchable members 34 is connected. As illustrated in FIG. 1, the second end 44 of each of the stretchable members 34 is connected to a second selector assembly 46 that is slidably movable along connector strut 22. Second selector assembly 46, which is of a substantially identical construction to first selector assembly 36, includes a box-like body 48 that includes a sleeve portion 48*a* that circumscribes the connector strut 22 and a pair of connector toggles 50 that are operable by the trainee to permit the pin portions of the toggles (not shown) to be removed from a selected one of the apertures 26 provided in the connector strut 22 so as to permit the selector assembly to be moved along the connector strut.

By moving the first selector assembly 36 along elongate body engaging member 28 so as to stretch, or relax the stretchable members 34, the resistance offered by the stretchable members to movement of the body engaging member 28 can be controllably varied. Alternatively, by moving the second selector assembly 46 along connector strut 22 so as to stretch, or relax the stretchable members 34, the resistance offered by the stretchable members to movement of the body engaging member 28 can also be controllably varied.

Figure 5:
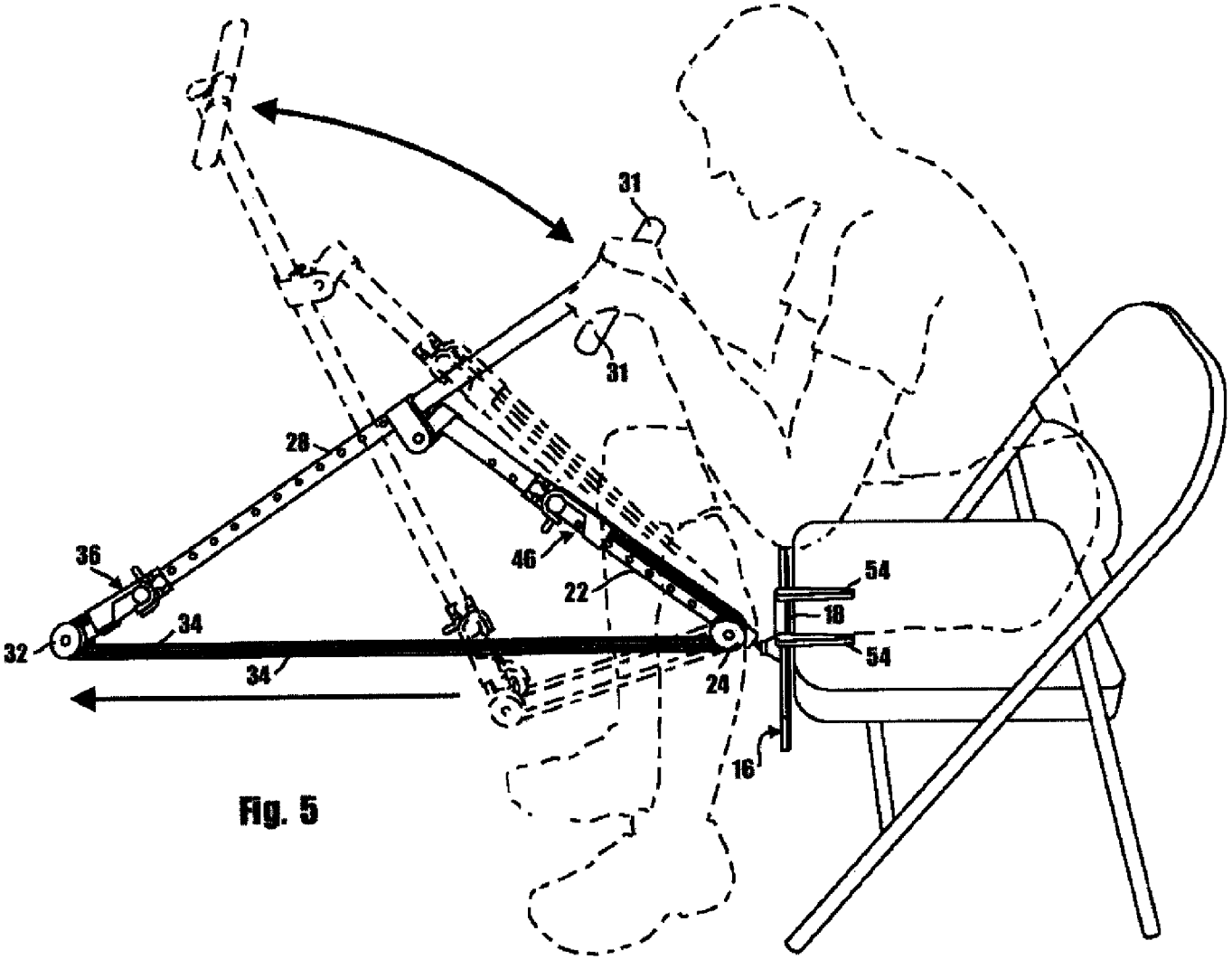
FIG. 5 is a generally diagrammatic view similar to FIG. 4 showing the apparatus of the invention connected to a chair and showing the trainee seated in the chair and using the apparatus to perform an exercise.

As illustrated in FIGS. 1, 3 and 5, base assembly 16 further includes two pairs of chair engaging members 54 that are pivotally connected to the central portion 18 of the base assembly 16 for movement between the stowed position shown in FIG. 1 to the extended position shown in FIGS. 3 and 5, wherein the exercise apparatus can be connected to the seat of a chair. With the chair engaging members 54 extended, they can be positioned over the chair seat in the manner shown in FIGS. 3 and 5 so that the apparatus can be removably connected to the chair seat. With the trainee seated in the chair in the manner shown in FIG. 5, the trainee can perform several different resistance exercises. For example, by gripping the hand grips 31, the elongate body engaging member 28 can be moved against the resistance of the stretchable members 34 between the first position shown by the phantom lines in FIG. 5 and the second position shown by the solid lines.

As illustrated in FIG. 4, similar resistance exercises can be performed by the trainee when the spaced apart foot engaging members 20 are positioned on the floor "F". In this instance, the trainee steps on the foot engaging members, grips the hand grips 31 and pulls the elongate body engaging member 28 against the resistance of the stretchable members 34 from the first position shown by the phantom lines in FIG. 4, to the second position shown by the solid lines. In this way, the muscles of the arms, shoulders, the back and the stomach can be progressively exercised.

Figure 6:
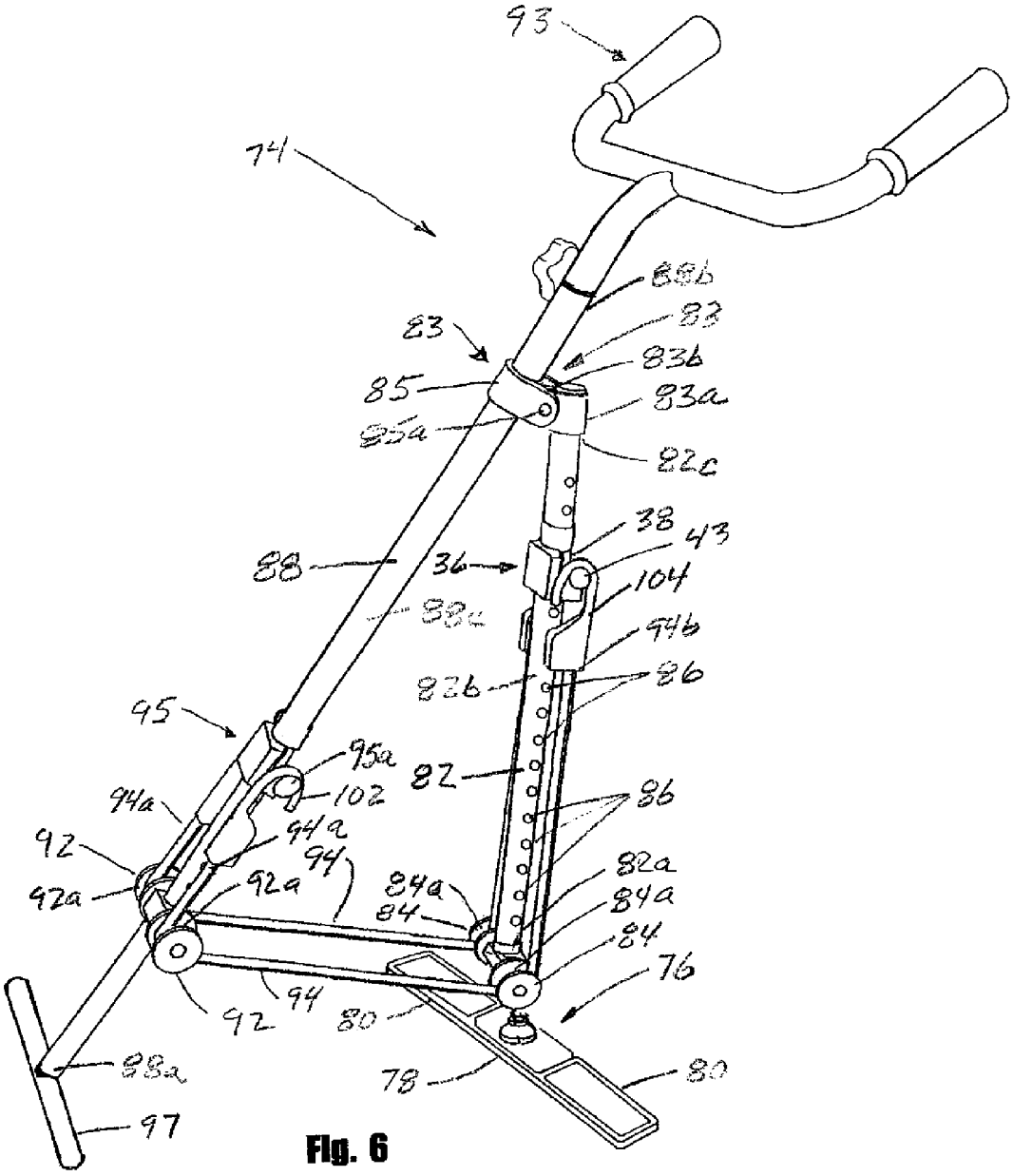
FIG. 6 is a generally perspective view of an alternate form of the apparatus of the invention.
Figure 7:
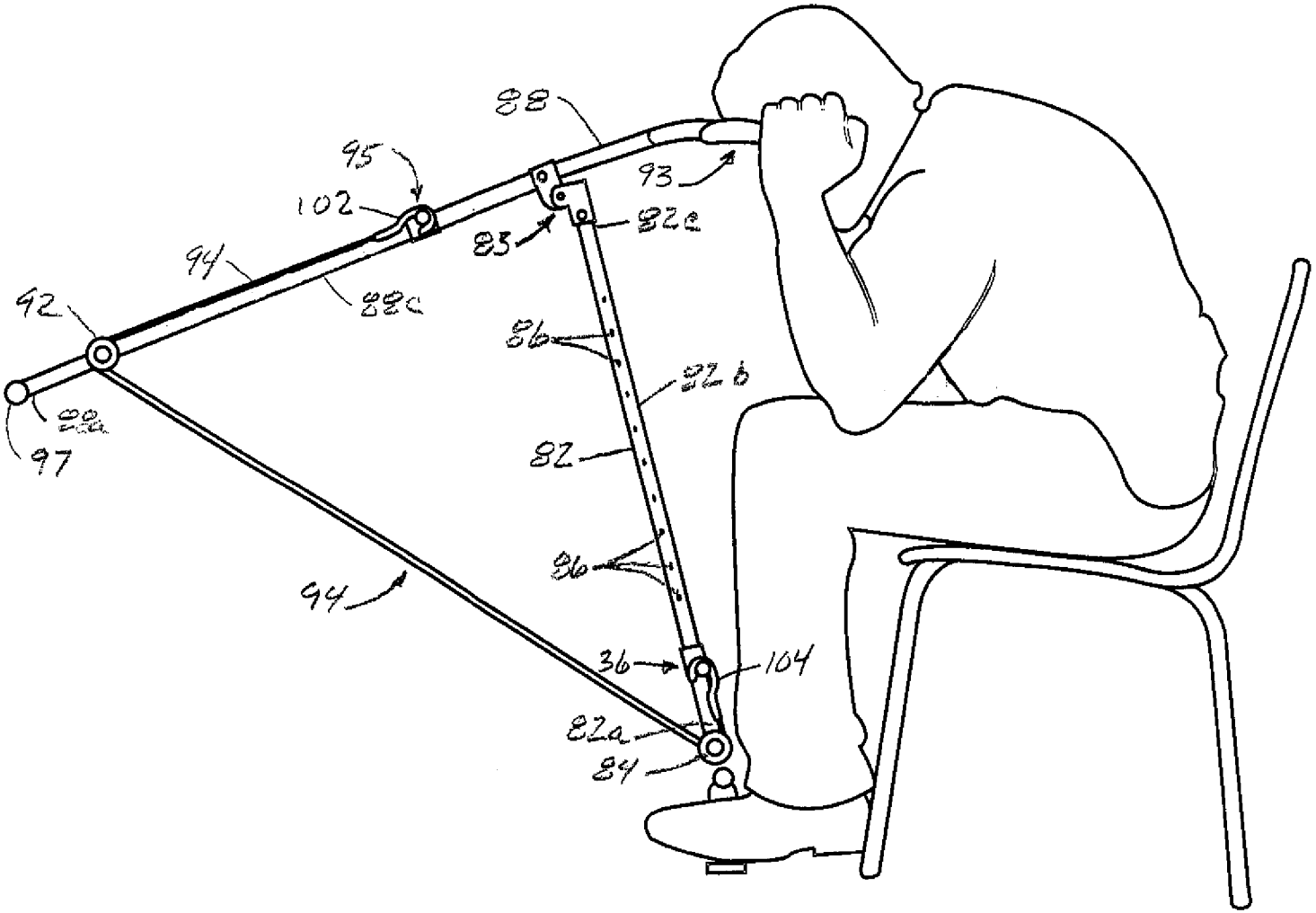
FIG. 7 is a generally diagrammatic view showing the use of the alternate form of the apparatus to perform an exercise.

Referring now to FIGS. 6 and 7 of the drawings, an alternate form of the exercise apparatus of the invention is there shown and generally designated by the numeral 74. Apparatus 74 is similar in some respects to the earlier described embodiment of the invention and like numerals are used in FIGS. 6 and 7 to identify like components. Apparatus 74 here comprises a base assembly 76 that includes a central portion 78 and a pair of spaced apart foot engaging members 80 that are pivotally connected to the central portion for movement between the normal extended position and the stowed position. Also pivotally connected to central portion 78 of the base assembly is an elongate strut 82. Strut 82 has a first end 82*a*, an intermediate portion 82*b* and a second end 82*c* that is spaced apart from first end 82*a*. The first end of the strut 82 is pivotally connected to the central portion of the base assembly in the manner shown in FIG. 6. For a reason presently to be described, the intermediate portion of the strut is also provided with a plurality of spaced apart apertures 86. Rotatably connected to connector strut 82 proximate the first end 82*a* is a pair of transversely spaced apart first guide members, shown here as a pair of first sheaves 84 each having an elastomeric belt receiving groove 84*a*.

Also forming a part of the exercise apparatus of this latest embodiment of the invention is an elongate body engaging member 88 that is movable by the trainee between a first position shown in FIG. 6 and a second position shown in FIG. 7. Body engaging member 88 has a first end 88*a*, a second end 88*b* and an intermediate portion 88*c*. As shown in FIG. 6, the second end 82*c* of the connector strut 82 is pivotally connected to the intermediate portion 88*c* of the body engaging member by means of a connector assembly 83. Connector assembly 83 includes a strut cap 83*a* that is affixed to the first end of the strut and a cooperating connector yoke 85 that is carried by the intermediate portion 88*c* of the body engaging member. Strut cap 83*a* has an outwardly extending, apertured tongue 83*b* that receives a pivot pin 85*a* that extends through the side portions of the connector yoke 85 in the manner shown in FIG. 6.

Rotatably connected to body engaging member 88 proximate its first end 88*a* is a pair of transversely spaced apart second guide members, shown here as a pair of second sheaves 92 each having an elastomeric belt receiving groove 92*a*. Removably connected to body engaging member 88 proximate its second end 88*b* is a generally yoke shaped handgrip assembly 93.

For a purpose presently to be described, intermediate portion 88*c* of the body engaging member is provided with a box-like connector assembly 95 having outwardly extending connector arms 95*a*. As illustrated in FIG. 6 of the drawings, a ground engaging crossbar 97 is connected to the first end of the body engaging member for providing stability to the apparatus when the apparatus is in the rest position shown in FIG. 6.

Forming an important part of the exercise apparatus of the invention is a resistance means that functions to yieldably resist movement of the body engaging member from the first position to the second position. This important resistance means here comprises a pair of stretchable, elastomeric belts 94 that are entrained about sheaves 84 and 92 in the manner illustrated in FIG. 6 of the drawings and function to operably interconnect the body engaging member 88 with the connector strut 82. More particularly, as best seen in FIG. 6, each of the stretchable belts 94 has a first end 94*a* that is provided with a hook-like member 102 and a second end 94*b* that is provided with a hook-like member 104. Hook like members 102 are removably connected to the outwardly extending connector arms 95*a* of box-like connector assembly 95 that is fixedly connected to the intermediate portion of the body engaging member 88 in the manner illustrated in FIG. 6 of the drawings.

Figure 2:
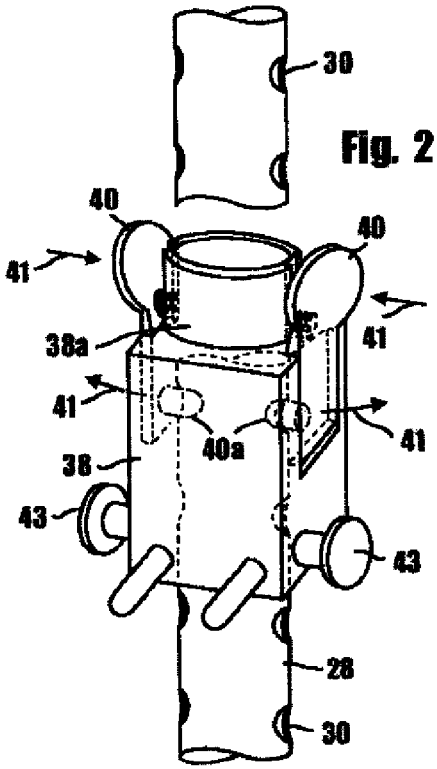
FIG. 2 is a greatly enlarged, fragmentary view of the area designated as 2-2 in FIG. 1.

Connected to elongate strut 82 for slidable movement there along between the first and second positions is a selector assembly 36. Selector assembly 36, which is similar in construction and operation to that previously described and illustrated in FIG. 2 of the drawings here includes a box-like body 38 that includes a sleeve portion 38*a* that circumscribes the strut and a pair of connector toggles 40 that are operable by the trainee to permit the pin portions 40*a* of the toggles to be removed from a selected one of the apertures 86 provided in the strut (see arrows 41 of FIG. 2) so as to permit the selector assembly to be moved along the strut from a first position to a second position. Selector assembly 36 also includes a pair of outwardly extending connector elements 43 to which hook like members 104 are removably connected in the manner illustrated in FIG. 6 of the drawings.

By moving selector assembly 36 along strut 82 so as to stretch, or relax the elastomeric belts 94, the resistance offered by the belts to movement of the body engaging member 88 can be controllably varied. In using the exercise apparatus of this latest form of the invention, the trainee sits on a chair in the manner illustrated in FIG. 7, places the feet on the foot engaging members 80 and grips the handlebar 93 with both hands. By pulling downwardly on the handlebar 93, the body engaging member 88 will move to the second and elevated position shown in FIG. 7 against the resistance of the elastomeric belts 94. As the handlebar 93 is pulled downwardly by the trainee, the elastomeric belts 94, which are entrained about the sheaves 84 and 92, will be controllably stretched. As previously discussed herein, the resistance offered by the elastomeric belts 94 can be controllably adjusted by moving the selector assembly 36 along the connector strut 82. This movement is accomplished through operation of the connector toggles 40 in a manner to remove the pin portions of the toggles from the apertures 86 so as to permit sliding movement of the selector assembly along the connector strut 82.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention as set forth in the following claims.

The invention claimed is:

1. An exercise apparatus for use by a trainee in the performance of exercises comprising:

(a) a base assembly including a central portion and a pair of spaced apart foot engaging members pivotally connected to said central portion;

(b) a connector strut having a first end pivotally connected to said base assembly, a second end spaced apart from said first end and an intermediate portion, said intermediate portion having a plurality of spaced apart apertures;

(c) a first sheave having a belt receiving groove rotatably connected to said connector strut proximate said first end thereof;

(d) a selector assembly connected to said connector strut for movement between a first position and a second position, said selector assembly including a connector pin removably receivable within a selected one of said plurality of spaced apart apertures provided in said intermediate portion of said connector strut;

(e) a body engaging member having a first end, a second end and an intermediate portion, said second end of said connector strut being pivotally connected to said intermediate portion of said body engaging member, said body engaging member being movable between a first position and a second position;

(f) a second sheave having a belt receiving groove rotatably connected to said body engaging member proximate said first end thereof;

(g) a box connector assembly connected to said intermediate portion of said body engaging member, said box connector assembly having an outwardly extending connector arm; and (h) a resistance assembly for yieldably resisting movement of said body engaging member from said first to said second position, said resistance assembly comprising an elastomeric belt entrained about said first and second sheaves, said elastomeric belt having a first end connected to said selector assembly and a second end connected to said outwardly extending connector arm of said box connector assembly.

2. The exercise apparatus as defined in claim 1 further including a generally yoke shaped handgrip connected to said second end of said body engaging member.

3. The exercise apparatus as defined in claim 1 further including a ground engaging crossbar connected to said first end of said body engaging member.

4. The exercise apparatus as defined in claim 1 in which each of said first and second ends of said elastomeric belt is provided with a hook member.

5. An exercise apparatus for use by a trainee in the performance of exercises comprising:

(a) a base assembly including a central portion and a pair of spaced apart foot engaging members pivotally connected to said central portion;

(b) a connector strut having a first end pivotally connected to said base assembly, a second end spaced apart from said first end and an intermediate portion, said intermediate portion having a plurality of spaced apart apertures;

(c) a pair of transversely spaced apart first sheaves rotatably connected to said connector strut proximate said first end thereof;

(d) a selector assembly connected to said connector strut for movement between a first position and a second position, said selector assembly including a connector pin removably receivable within a selected one of said plurality of spaced apart apertures provided in said intermediate portion of said connector strut;

(e) a body engaging member having a first end, a second end and an intermediate portion, said second end of said connector strut being pivotally connected to said intermediate portion of said body engaging member, said body engaging member being movable between a first position and a second position;

(f) a pair of transversely spaced apart second sheaves rotatably connected to said body engaging member proximate said first end thereof;

(g) a handgrip connected to said second end of said body engaging member;

(h) a box connector assembly connected to said intermediate portion of said body engaging member, said box connector assembly having an outwardly extending connector arm; and (i) a resistance assembly for yieldably resisting movement of said body engaging member from said first to said second position, said resistance assembly comprising a pair of transversely spaced apart elastomeric belts operably associated with said pair of transversely spaced apart first and second sheaves, said elastomeric belts having a first end connected to said selector assembly and a second end connected to said outwardly extending connector arm of said box connector assembly.

6. The exercise apparatus as defined in claim 5 further including a ground engaging crossbar connected to said first end of said body engaging member.

7. The exercise apparatus as defined in claim 5 further including a connector assembly pivotally interconnecting said connector strut with said body engaging member, said connector assembly including a strut cap affixed to said second end of said connector strut and a connector yoke carried by said body engaging member and pivotally connected to said strut cap.

8. The exercise apparatus as defined in claim 5 in which said first and second ends of each of said pair of elastomeric belts is provided with a hook member.

* * * * *